United States Patent [19]

Wolf

[11] 4,009,879

[45] Mar. 1, 1977

[54] BARNSTORMER GAME

[76] Inventor: Tobin Wolf, 285 Aycrigg Ave., Passaic, N.J. 07055

[22] Filed: Feb. 27, 1975

[21] Appl. No.: 553,690

[52] U.S. Cl. ..... 272/31 A; 272/37

[51] Int. Cl.[2] ..... A63H 17/00

[58] Field of Search ..... 272/31 A, 31 B, 31 C, 272/31 R, 44, 48, 7, 36, 37, 50; 40/139

[56] References Cited

UNITED STATES PATENTS

| | | | |
|---|---|---|---|
| 451,373 | 4/1891 | Fowler | 272/37 |
| 739,691 | 9/1903 | Manig | 272/44 UX |
| 817,771 | 4/1906 | Helmer | 272/31 R |
| 1,066,640 | 7/1913 | McLevie | 272/37 |
| 1,825,921 | 10/1931 | Roeder | 272/31 R |
| 2,200,864 | 5/1940 | Spinelli | 272/31 R X |
| 2,881,001 | 4/1959 | Chisholm et al. | 272/31 P |
| 3,375,600 | 4/1968 | Poulos | 272/31 AX |

FOREIGN PATENTS OR APPLICATIONS

| | | | |
|---|---|---|---|
| 934,672 | 1/1948 | France | 272/37 |
| 941,562 | 7/1948 | France | 272/31 R |
| 931,698 | 8/1955 | Germany | 272/31 A |

*Primary Examiner*—Paul E. Shapiro
*Assistant Examiner*—Arnold W. Kramer
*Attorney, Agent, or Firm*—Jay M. Cantor

[57] ABSTRACT

A game which can be played by two or more people wherein an airplane is made to fly in a circular path with random vertical movements, each player attempting to build a tower of blocks in the haphazard path of the diving airplane. Since the maximum vertical height of the airplane path is higher than the maximum height of the tower to be built, it is possible that one or more passes of the tower can be made by the airplane at a height which is above the maximum height to which the tower will be built. However, the player has no way of knowing at what height the plane will be when the pass of his tower is made. The first player to complete his tower to the maximum height will be the winner.

The game is composed of a board of preferably square shape having marked positions at the corners for building of the towers. A base member is positioned in the center of the board above which is mounted a housing for rotary motion about the base member. An airplane is coupled to the housing for circular flight with the rotation of the housing, the airplane being mounted on an arm which is coupled to a cam which is mounted on the housing to provide a variable and random vertical component to the travel path of the arm, thereby causing the airplane to have randomly variable vertical motion during its circular flight path.

10 Claims, 3 Drawing Figures

BARNSTORMER GAME

This invention relates to a game utilizing a mechanism which provides random flight to an airplane and, more specifically, to a mechanism which provides circular as well as random vertical movements to an airplane when moving in the circular path.

It is necessary for use in a game that there be provided a game board wherein the airplane, rotating about the center of the board, is capable of rotary as well as random vertical movements throughout its path. It is also necessary that this game board be provided with a relatively simple and inexpensive mechanism.

In accordance with the present invention there is provided a simple and inexpensive mechanism which is capable of providing rotary motion as well as random vertical motion along the rotary path. Briefly, this is accomplished by providing a board of preferably square shape having marked positions at the corners for building of the towers. A base member is positioned in the center of the board above which is mounted a housing for rotary motion about the base member. The airplane is coupled to the housing for circular flight with the rotation of the housing, the airplane being mounted on an arm which is coupled to a cam which is mounted on the housing to provide a variable and random vertical component to the travel path of the arm, thereby causing the airplane to have randomly variable vertical motion during its circular flight path.

The mechanism which provides this randomly variable vertical motion comprises a gear shaft which is fixed in the base and has a gear-pinion affixed thereto. A main spring is provided which, when wound up, drives a drive gear which is coupled to the pinion. Since the pinion is fixed to the base, the drive gear rotates about the pinion and causes the housing to rotate around the pinion also, this providing the circular path for the airplane. The speed of rotation of the drive gear is controlled by means of a star-wheel and escapement mechanism, this being standard for use with spring motors.

A key is provided which is journalled on the drive gear axis and permits winding up the spring of the motor by turning a ratchet affixed to one end of the spring, said ratchet having a finger which depends into apertures on the drive gear, permitting the drive gear to remain stationary as the spring is wound and to be driven as the spring unwinds. The key extends through an aperture in the face cam which is positioned above the housing, the aperture being of substantially identical cross-section with the key so that rotation of the key in the drive gear also causes the face cam to rotate. A plurality of lobes are positioned randomly around the periphery of the face cam, these lobes striking the cam follower of the arm attached to the airplane when passing thereunder, thereby rotating the arm and causing the airplane to move downwardly during its circular travel path.

It is therefore an object of this invention to provide an inexpensive apparatus for providing circular and random vertical motion simultaneously.

It is a further object of this invention to provide a key wound spring motor wherein, operation of the spring motor provides a revolving movement of a cam, driven by the spring motor around a central fixed gear, rotation of the key during the unwinding process also causing a cam having randomly positioned lobes about the edges thereof to be rotated, the lobes passing under a cam follower which provide a vertical component of motion to the cam follower, thereby permitting an arm attached to the cam and to an aircraft or the like to be moved in a vertical direction as well as in the circular direction.

It is a yet further object of this invention to provide an apparatus capable of providing separate motion along two axes, each motion being separately controlled, the apparatus providing rotary motion simultaneously about two parallel and spaced axes.

The above objects and still further objects of the invention will immediately become apparent to those skilled in the art after consideration of the following preferred embodiment thereof, which is provided by way of example and not by way of limitation, wherein.

Figure 1:
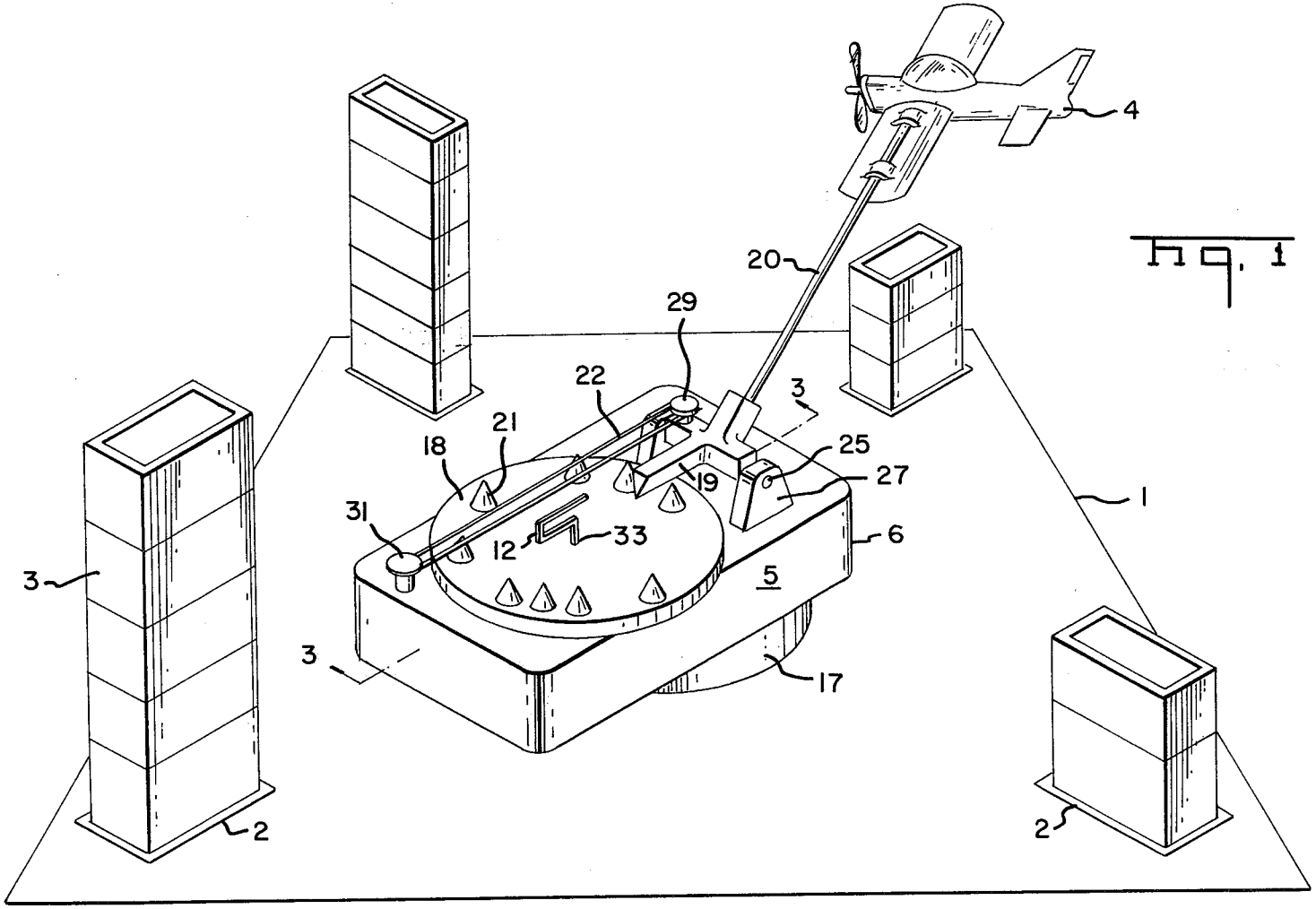
FIG. 1 is a view in elevation of the game board.

Referring now to FIG. 1 there is shown a playing board 1 with positions 2 wherein a player will build a tower out of blocks 3. The object of the game is to have a tower built with the blocks before the airplane 4, which moves in a circular path with random vertical movement, will knock over the tower. The first player to complete the tower is, of course, the winner. The airplane is caused to rotate in its rotary path as well as vertical path by means of the mechanism 5 shown in FIG. 1. The mechanism 5 is formed with a base 17 which is affixed to the board 1 and around which the housing 6 rotates to provide the circular motion to the aircraft. Also on the housing 6 is a face cam 18 having lobes 21 thereon which rotate around the cam midpoint. The lobes 21, which are randomly spaced around the edge of the face cam 18, come in contact with the cam follower 19 which is attached to the arm 20, which, in turn, is attached to the airplane 4. The cam follower 19 rotates about the pivot 25, the pivot 25 being mounted in the element 27 which is affixed to the housing 6. The cam follower 19 is maintained in contact with the cam 18 by means of a rubber band 22 which is coupled to the mounting member 29 on the cam follower 19 and the mounting member 31 on the housing 6. Circular motion is provided to the cam 18 by means of the key 12 which fits into the aperture 33, the aperture 33 having substantially the same cross-sectional dimensions as the key so that rotation of the key by the mechanism within the housing 6 (to be explained hereinbelow) will cause rotation of the cam 18.

Figure 2:
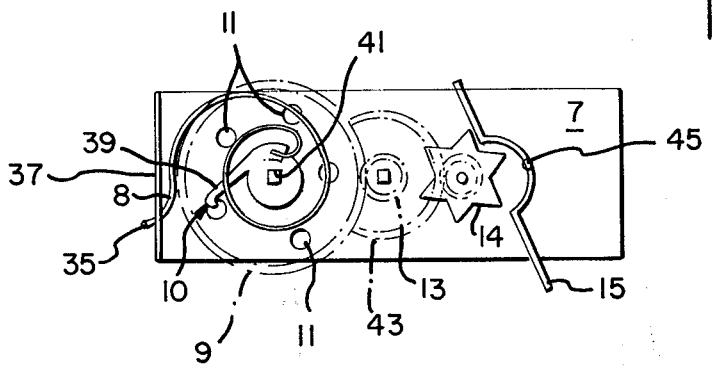
FIG. 2 is a top view of the spring motor.
Figure 3:
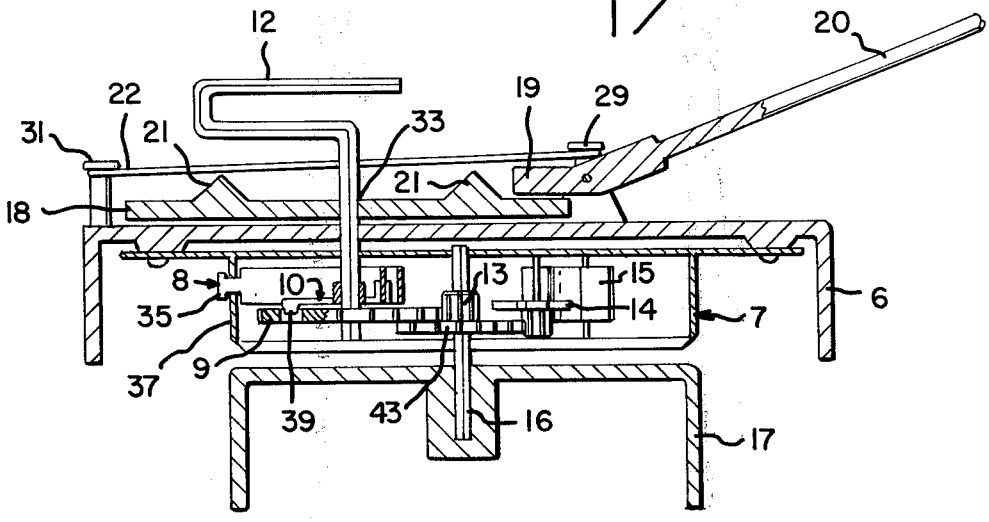
FIG. 3 is a view taken along the line 3—3 of FIG. 1.

Referring now to FIGS. 2 and 3, there are shown details of the mechanism for causing both the circular and random vertical motion to the aircraft 4 and to provide the movement described with respect to FIG. 1. The mechanism includes within the housing 6 a conventional spring motor 7 which is affixed thereto. The spring motor 7 comprises a main spring 8 which is locked at one end 35 in the wall 37 of the housing for the motor 7. The spring 8 is secured at its other end to a ratchet 10 having a finger element 39 which depends into the apertures 11 when positioned thereover. The ratchet 10 includes an aperture 41 which has the same internal dimensions as the outer cross-section dimensions of the key 12, the key 12 fitting therein and winding up the spring 8 by rotation of the key in a clockwise manner. As can be seen in FIG. 3, the key 12 also has the same cross-sectional dimensions as the aperture 33 in the cam 18.

The apertures 11 are formed in the drive gear 9 as mentioned above, the drive gear 9 being rotatably mounted on the shaft of key 12 and meshing with an intermediate pinion 13 secured to an intermediate gear shaft 16 extending therethrough which is fixed in the base 17. A further gear 43 is also affixed to the gear shaft 16 and rotates the star-wheel 14 which operates under control of the escapement lever 15 in well known manner. The escapement lever 15 rotates about the pivot 45 which is secured in the member 37 of the spring motor. If desired, a mechanism (not shown) can be provided to prevent movement of the escapement lever 15 and act as an on-off switch. The upper end of shaft 16 extends through an opening in the spring motor housing 7 so that the latter can rotate about the axis of shaft 16 by orbital movement of the gear thereabout.

In operation, the key 12 is rotated in a clockwise direction to wind up the spring 8. When the spring 8 is wound up and the key 12 is released, the drive gear 9 will rotate under the force applied by the spring to the ratchet 10, the gear 9 being meshed with the intermediate pinion 13 causing the gear 9 to revolve around the pinion 13 since the shaft 16, onto which the pinion 13 is attached, is fixed in the base member 17. This rotation of the gear 9 around the pinion 13 will cause the entire housing 6 to rotate in a circular path about the gear shaft 16 as can be seen. The spring 8 will unwind in a relatively slow manner due to the action of the star-wheel and escapement mechanisms 14 and 15 which operate in well known manner.

The key 12 fits through an aperture in the housing 6, this aperture being sufficiently large so that there is no contact between the key and the wall of the aperture. However, the aperture 33 in the cam 18 is designed to be of substantially identical cross-sectional dimensions as the key 12 so that the key makes a good locking fit therein and causes the cam 18 to rotate as it rotates with the key 12. Since the cam 18 is coupled to the gear 9, through ratchet 10 the cam 18 will rotate at the same time that the housing 6 is rotating. Rotation of the housing 6 about the shaft 16 causes the cam follower 19 and arm 20 to rotate in a circle about the shaft 16 and thereby provide the circular motion to the aircraft as shown in FIG. 1. In addition, the rotation of the cam 18 with the random positioning of the lobes 21 around the perimeter thereof, causes the cam follower 19, which is biased in the position shown in FIGS. 1 and 3 by the rubber band 22, to rotate to the right, thereby providing a downward motion to the aircraft 4. When the lobe 21 passes through the cam follower 19, the aircraft will then rise back to its uppermost position due to the bias caused by the rubber band 22. Since the lobes 21 are randomly spaced and are of different heights, it can be seen that the aircraft will have motion along the perimeter of a circle as well as random vertical movements, the time of these movements not being discernible to any of the players. Since the cam 18 is held in position by means of the key 12, it can be seen that the cam 18 can be replaced by other cams having other arrangements of lobes 21 thereon, thereby varying the random movements of the airplane 4 so that the random movements cannot be learned from substantial use of only one cam. To replace the cam in the disclosed embodiment, the upper horizontally extending handle portion of the key 12 may be removable, so that the vertical portion thereof remains as the support for gear 9 as the cam is removed.

Though the invention has been described with respect to a specific preferred embodiment therof, many variations and modifications thereof will immediately become apparent to those skilled in the art. It is therefore the intention that the appended claims be interpreted as broadly as possible in view of the prior art to include all such variations and modifications.

What is claimed is:

1. A toy or game which includes a base,
a platform rotatable on said base about a first axis,
camming means rotatable on said platform about a second axis displaced from and parallel to the first axis and provided with a plurality of randomly spaced lobes,
drive means
means cooperating with the drive means to effect simultaneously rotation of the platform and said camming means about their respective axes.
an object, means mounting said object to the platform to rotate therewith about said first axis and to have motions normal to the plane of said platform,
said object being provided with a cam follower cooperating with each of said lobes for effecting said motions of the object normal to the plane of said platform at random intervals upon operation of said drive means.

2. A toy or game according to claim 1 wherein at least some of said lobes differ in height from one another.

3. A toy or game according to claim 1 including means for normally biasing the cam follower toward the camming means.

4. A toy or game according to claim 3 wherein at least some of said lobes differ in height from one another.

5. A toy or game according to claim 1 wherein said platform is mounted for rotation in a horizontal plane.

6. A toy or game according to claim 5 wherein at least some of said lobes differ in height from one another.

7. A toy or game according to claim 6 wherein the cam follower is normally biased toward the camming means.

8. A toy or game according to claim 6 wherein said drive means includes a windable spring,
the means cooperating with the drive means comprising,
means operated by the spring when unwinding to rotate the camming means,
a first gear rotated by the spring during unwinding and mounted on the platform,
a second gear meshing with said first gear and fixed to the base against rotation about said first axis,
whereby rotation of the first gear provides orbital movement thereof about the second gear to rotate the platform about the first axis.

9. A toy or game according to claim 7 further including a plurality of spaced towers, one for each of a number of players, in the path of circular rotation of said object,
said towers each comprising a plurality of easily removable blocks stacked one upon the other.

10. A toy roundabout having simultaneous horizontally circular and seemingly random vertical motions of a simulated object which includes a base, a platform rotatable on said base about a first axis, camming means rotatable on said platform about a second axis parallel to and displaced from said first axis, drive means on said base, means cooperating with the drive means to effect simultaneous rotation of the platform and said camming means about their respective axes, an angled arm lying in a plane perpendicular to the planes of said platform and camming means and pivotally mounted on said platform about a third axis perpendicular to said first and second axes, one end of said arm being overlapped with respect to said camming means, means biasing said one end of said arm into engagement with said camming means, said one end of said arm acting as a cam follower actuated for vertical movement by said camming means rotating with respect thereto, and a simulated object mounted on the other end of said arm, whereby said simulated object on said arm is carried in a circuitous path on rotation of said platform and is simultaneously vertically reciprocated by rotation of said camming means.

* * * * *